United States Patent [19]

Weirich et al.

[11] 4,438,671

[45] Mar. 27, 1984

[54] CUTTER FOR SLOT WEDGES

[75] Inventors: Stephen Weirich; James L. Crothers, both of Lenni, Pa.

[73] Assignee: Lenni Products, Inc., Lenni, Pa.

[21] Appl. No.: 439,730

[22] Filed: Nov. 8, 1982

[51] Int. Cl.[3] ..... B26D 5/38

[52] U.S. Cl. ..... 83/212; 83/167; 83/176; 83/444; 83/468; 83/580; 83/694

[58] Field of Search ..... 83/212, 580, 694, 582, 83/176, 167, 444, 468

[56] References Cited

U.S. PATENT DOCUMENTS

| | | | |
|---|---|---|---|
| 2,581,960 | 1/1952 | Kronenwetter | 83/212 |
| 2,707,026 | 4/1955 | Hoern | 83/580 X |
| 3,082,655 | 3/1963 | Voigt | 83/580 X |
| 3,220,294 | 11/1965 | Bradburn, Sr. | 83/580 |
| 3,777,603 | 12/1973 | Tracy | 83/212 |
| 3,785,233 | 1/1974 | Robinson | 83/580 X |

*Primary Examiner*—Frank T. Yost

*Attorney, Agent, or Firm*—Howson and Howson

[57] ABSTRACT

Slot wedges are cut from lengths of wedge stock having a generally U-shaped transverse cross-section by air-operated shearing means triggered when an end of the wedge stock contacts a paddle mounted with a paddle-operated electrical switch on a slide assembly movable longitudinally along the path of feed of wedge stock past the shearing means. The shearing means comprises a movable blade having an external symmetrical U-shaped cutting edge cooperating with a fixed blade having an internal symmetrical U-shaped cutting edge with a rounded end and straight, parallel sides. A guide dial with multiple selectable apertures is used to center the wedge stock on the shearing means. The guide dial is aided by an upward protrusion which projects between the legs of the wedge stock cross-section to keep the wedge stock perpendicular to the cutting plane. The movable blade is constantly urged against the fixed blade by a spring-loaded ball bearing, and is actuated by an air cylinder piston having a flat surface transverse to the direction of blade movement so that the blade is permitted to move laterally as wear takes place. The paddle pre-stresses the paddle-operated switch so that only a very slight movement of the wedge stock is needed to trigger the shearing means. The slidable switch and paddle assembly carries with it an overhanging shield which prevents the cut wedges from flying upwardly regardless of their size.

13 Claims, 10 Drawing Figures

CUTTER FOR SLOT WEDGES

BRIEF SUMMARY OF THE INVENTION

This invention relates to the cutting of slot wedges for electrical rotating machinery, and particularly to an improved apparatus adapted for use in cutting formed wedge stock in electric motor and generator repair shops.

A slot wedge is a strip of insulating material placed in a slot in the stator core or rotor core of an electrical motor or generator. The wedge cooperates with insulating slot liners to surround the conductors in the slot completely, thereby insulating the conductors from the iron of the stator or rotor core. A typical wedge has a U-shaped cross-section, with the legs of the U diverging somewhat. The bottom of the U is typically either round or flat.

Slot wedges have been made from various materials, including wood, varnished rag or fiber material, polyesters, polyester laminates such as DMD (DACRON-MYLAR-DACRON), polyester-rag laminates, and polyamide fiber compositions such as NOMEX.

In the operation of an electric motor or generator, damage to the copper conductor windings occurs primarily as a result of bearing wear. Bearing wear ultimately causes the stator and rotor to come into contact with each other while the device is in operation. When this contact occurs, metal fragments are thrown off, and these fragments damage the copper conductors. A substantial market exists for replacement wedges because electric motors and generators are frequently rebuilt, and in the rebuilding process it is usually necessary to remove and replace damaged copper conductors in the stator or rotor slots.

In any rebuilding operation in which a conductor has been damaged, it is usually necessary to replace all of the slot wedges of the motor or generator. Wedge stock is supplied in long lengths, and has usually been cut in the past by means of a rotating serrated cutting wheel. It is important that all wedges be cut to the same length. To this end, the person repairing the motor or generator typically formed a bundle of lengths of wedge stock, and cut them to length simultaneously with the cutting wheel. This operation necessarily resulted in the waste of some material, and was frequently inaccurate, as there was no convenient means of assuring that the lengths of wedge stock in the bundle were cut to the desired length.

The present invention utilizes the concept of a cutting knife which shears off lengths of wedge stock individually as the wedge stock is fed past the blades of the shearing device toward a trigger located at a predetermined distance from the cutting location. By using the wedge stock itself to activate the trigger, the wedge stock is automatically cut to the length determined by the distance between the trigger and the shearing device.

The concept of activating a shearing device by a stock-actuated trigger has been used in the past in cutting devices. However, until now it has not been practical to utilize this concept for cutting slot wedges, because no cutting device was known which would be suitable for cleanly cutting slot wedges in a wide variety of sizes, and at the same time suitable for actuation by a stock-activated trigger mechanism. A rotating cutting wheel or moving band cannot cut rapidly enough to permit continuous feed of wedge stock. Furthermore, it is necessary to move the cutting element, because moving the wedge stock against the cutting element would interfere with proper operation of the trigger. It is not practical to provide for movement of a cutting wheel or moving band. Conventional shearing blades cannot be used to cut wedge stock without causing damage because of the peculiar cross-sectional shape of the wedge stock. We have tried shearing blades specially designed to conform to a particular size and configuration of wedge stock, but have found that they do not generally make a clean cut in wedge stock of a size other than that for which the blades are designed.

In accordance with the invention, a shearing device is used which has specially formed cooperating blades, one blade having a U-shaped external cutting edge, and the other blade having an internal U-shaped cutting edge with a rounded end and sides which are substantially straight and parallel. In operation, the external U-shaped cutting edge of the first blade intersects the internal cutting edge of the second blade during relative movement of the blades at acute angles, whereby relative movement of the blades from a rest position to a cut-off position causes spreading of the sides of the U-shaped wedge stock outwardly against the sides of the internal U-shaped cutting edge of the second blade. This is followed by a clean cutting of an insulation wedge from the wedge stock. This blade edge configuration is capable of clean cutting of wedge stock in a wide range of materials, sizes and configurations. We have found that, for consistent clean cutting, the intersections between the edge of the movable blade and the straight parts of the fixed blade should be within the range of approximately 50° to 80° and that the best results are achieved at approximately 68°.

In accordance with the invention, special work guides are provided which maintain the wedge stock in a symmetrical relationship with respect to the cutting blades so that the cutting action just described can take place reliably.

The invention also makes it possible to operate the shearing device as described above more reliably and effectively by using an air cylinder to operate the shearing device, and providing the piston of the air cylinder with a flat head for engaging the end of a movable blade opposite its cutting edge. The head of the air cylinder piston is not directly connected to the cutting blade. Because of the flat surface on the head of the piston, the movable blade can move laterally toward its cooperating blade as wear takes place, and thereby continue to operate reliably. The relationship between the head of the piston and the movable blade also allows the movable blade to be easily removed and sharpened and eliminates the need for elaborate readjustment of the blade position to compensate for dimensional changes resulting from sharpening. The movable blade is urged toward its cooperating blade by a spring-loaded ball, and the compression in the spring is adjustable so that the force with which one blade is urged against the other can be controlled.

For very precisely cut and uniform wedges, the cutter in accordance with the invention uses a stock-actuated trigger comprising a microswitch and a flexible, resident paddle which normally urges the microswitch partly into its triggered condition so that only the slightest movement of the paddle is needed to trigger the cut-off device.

The objects of this invention include the achievement of more efficient and accurate cutting of wedge stock than was heretofore possible using conventional cutting methods; the avoidance of waste of wedge stock; the avoidance of damage to the wedge stock; and the achievement of high production rates. It is also an object of the invention to provide a cutting apparatus which is versatile in that it is capable of cutting wedge stock in a wide range of sizes. Finally, it is an object of the invention to provide a cutting apparatus for wedge stock which is highly durable and easy to maintain. Other objects of the invention will be apparent from the following detailed description when read in conjunction with the drawings.

DETAILED DESCRIPTION

Figure 1:
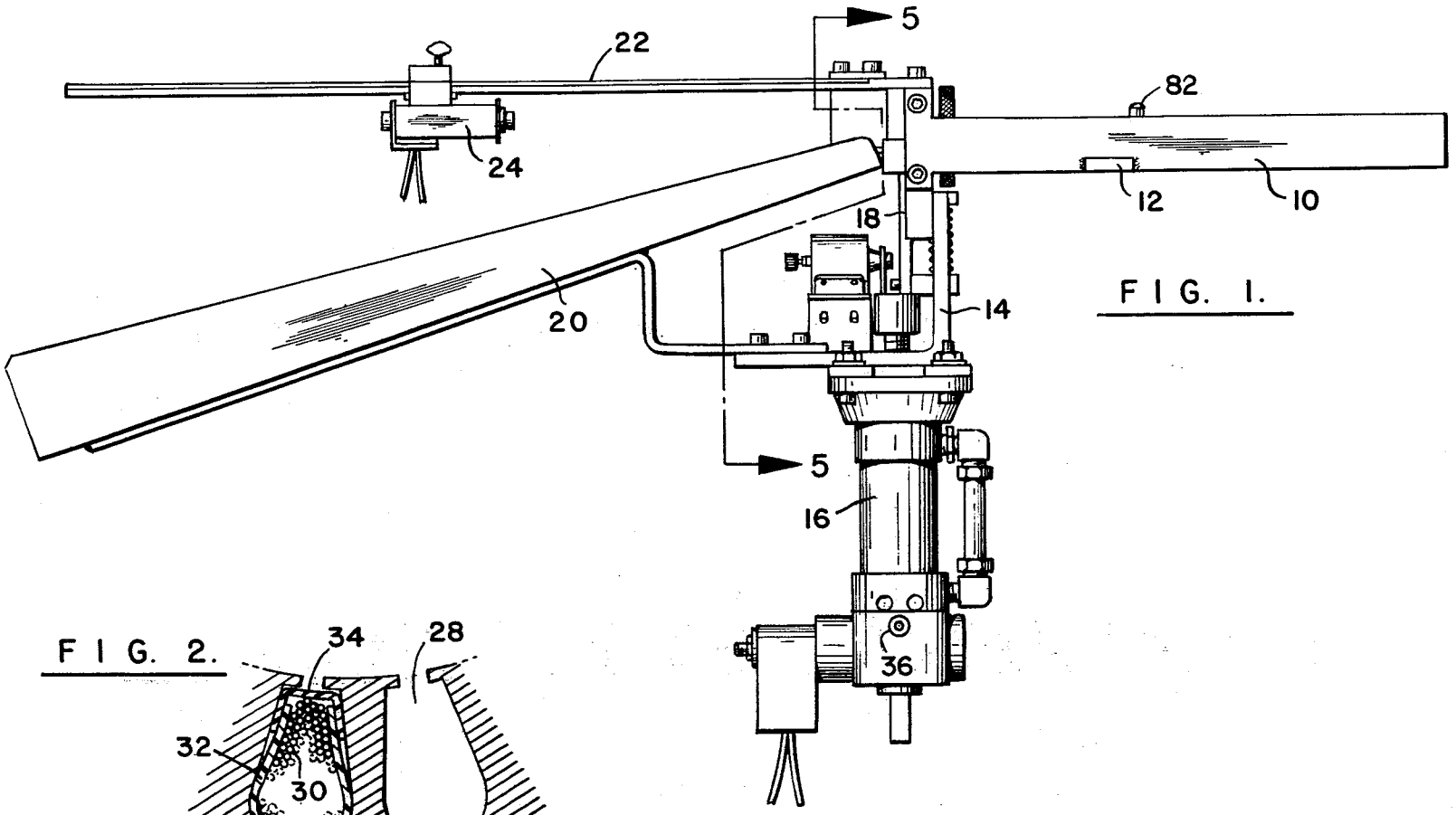
FIG. 1 is an elevational view of a bench-mountable wedge cutter in accordance with the invention.

The apparatus of FIG. 1 is designed to be mounted on the edge of a work bench or other suitable support. Base 10 overlies the horizontal surface of a work bench, and is bolted down to the work bench. A flange 12 is provided on one side of base 10 for this purpose, and a similar flange (flange 106 in FIG. 6) is provided on the opposite side of base 10.

A frame 14 extends downwardly from base 10, and supports an air cylinder 16. The air cylinder is provided to activate a cutting mechanism, which includes a movable blade 18. The blade is moved upwardly by the piston of the air cylinder from a rest position to a cut-off position. A collection tray 20 is also supported from frame 14. This tray collects wedges, as they are cut from wedge stock by the cutting mechanism. A bar 22 extends horizontally above the collection tray, and supports a slide assembly 24 which carries a trigger for activating the air cylinder.

In operation, wedge stock is fed over the top of base 10, and through the cutting mechanism toward slide assembly 24. When the wedge stock reaches the slide assembly, it closes a microswitch carried by the slide assembly, and the microswitch activates a solenoid-operated valve to deliver air to the cylinder. The cylinder then causes blade 18 to move upwardly, cutting a length of wedge stock, and dropping it into tray 20. The position of slide assembly 24 determines the length of the wedge cut off by the cutting mechanism.

Figure 2:
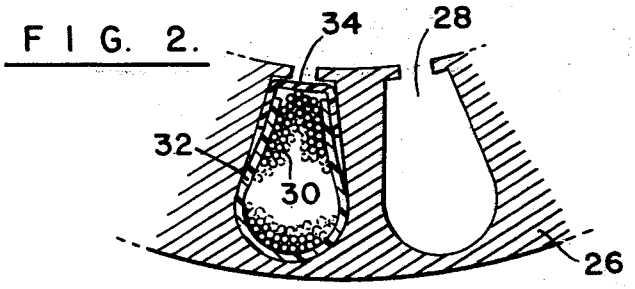
FIG. 2 is a fragmentary section of the stator core of a motor illustrating the location of a typical wedge in a stator slot, and its relationship to the conductors and to the slot liner.

FIG. 2 shows a typical motor stator core 26, having a series of axially extending slots, one of which is shown at 28. In the slot immediately to the left of slot 28, there is shown a bundle of conducting wires 30. These wires are insulated from the iron of the stator core by a slot liner 32, which is capped by a wedge 34. The wedge is held in place by the overhanging parts of the slot.

The wedge is generally U-shaped, as shown. Wedge 34 has a flat web, and legs which diverge slightly from the edges of the web. These wedges can take various forms. Other wedges, for example, are more rounded than wedge 34. Wedges are used in rotor slots as well as in stator slots.

In a typical repair operation, the wedge slides into place in the axial direction, after the slot liner and windings are set in place. After the wedges are installed, the rotor or stator is dipped in a suitable high-temperature varnish or resin.

A compressed air supply is connected to air channel 36 (FIG. 1) to operate air cylinder 16. By using an air-operated blade actuator instead of an electrical solenoid, adequate cutting force is achieved without excessive heat generation.

Figures 3, 4:
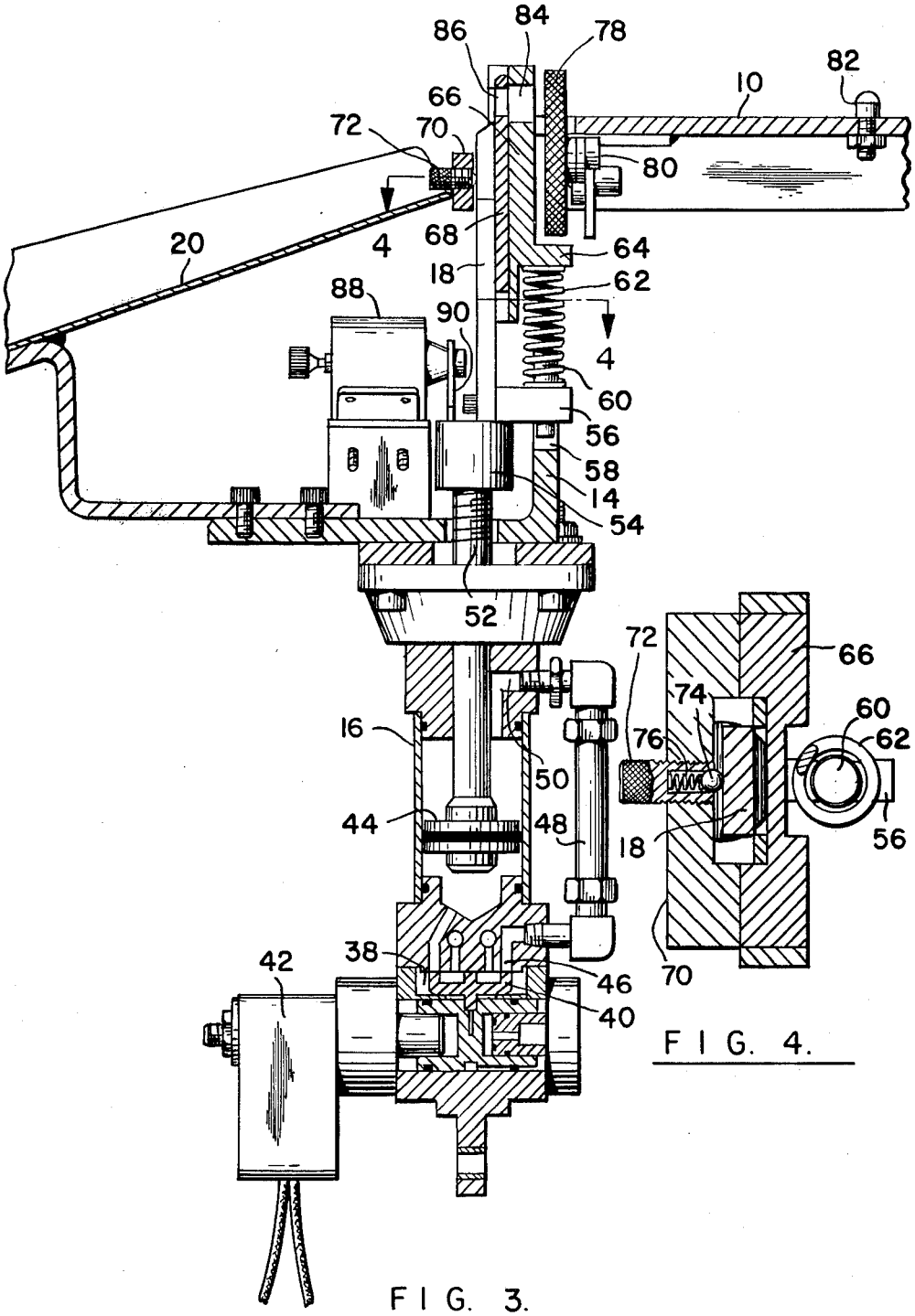
FIG. 3 is a longitudinal vertical section through the cutting apparatus, showing the blades, the wedge stock guides, and the air cylinder.
FIG. 4 is a horizontal section taken on the surface 4—4 of FIG. 3.

Referring to FIG. 3, the supply of compressed air is delivered to a valve chamber 38 having a sliding valve block 40 operated by an electrical solenoid 42. Solenoid 42 is connected to be operated by a trigger switch carried by slide assembly 24 through simple electrical connections (not shown). When solenoid 42 is activated and moves valve block 40 to the right, piston 44 within cylinder 16 is forced upwardly by compressed air. The piston is positively moved downwardly by compressed air when the solenoid is deactivated, there being a return spring in the solenoid assembly causing valve block 40 to move to the left, thereby opening port 46 and delivering air through connecting line 48 to the space above piston 44 through port 50. This produces a rapid return of the piston to its initial position as soon as cutting takes place so that feed of wedge stock can be substantially continuous.

Piston 44 is connected through piston rod 52 to a head 54 on which rests the lower end of movable blade 18. The surface on which the lower end of the movable blade rests is flat and perpendicular to the direction of piston movement. Blade 18 merely rests on this flat surface and is not directly connected to it. As the blade wears during use, it can move to the right relative to head 54 by sliding along the flat surface of the head. Thus, no readjustment of the blade is normally necessary in order to insure proper cutting. Likewise, the blade can be removed for sharpening or replaced with a new blade without the need for elaborate adjustments of the relationship between the blade and head 54 of piston rod 52.

A projection 56 extends horizontally from blade 18 through a vertically elongated guide slot 58. A vertical pin 60, fixed to projection 56, is received in the lower end of coil spring 62. The spring is in compression between projection 56, which is movable with the blade, and a fixed projection 64 on part 66 of the machine frame.

Secured to frame part 66 is a fixed blade 68 which cooperates with movable blade 18 in a manner which will be described in detail below. Movable blade 18 is constantly urged against fixed blade 68 by urging means supported on bracket 70, which is fixed to frame 66. The urging means comprises a pressure element 72 which is threaded into bracket 70, and which is shown in greater detail in FIG. 4. The pressure element consists of a cylinder having external threads and a blind bore in which is held a metal ball 74 urged against movable blade 18 by a compression spring 76. The metal ball is centered on blade 18 and located a short distance below the cutting edge of the blade when the blade is at rest. The ball rotates as the blade moves up and down. Pressure element 72 can be adjusted by rotation. It constantly applies pressure to movable blade 18, urging it against fixed blade 68, as shown in FIG. 3.

Wedge stock is guided toward the blades through a guide dial 78, which is rotatable about a horizontal axis on pin 80. Dial 78 has axial holes of different sizes, any one of which can be brought into alignment with the cutting location by rotation of the dial. The dial is provided to accommodate different sizes of wedge stock, and its significance will be more apparent from the subsequent discussion of the operation of the blades.

Extending upwardly from base 10, and spaced from dial 78, is an upward projection 82, which is in the form of a short cylinder having a rounded end. This projection serves as a guide, in that it projects upwardly between the legs of the wedge stock cross-section, and, with the holes in the dial, insures that the wedge stock enters the cutting location perpendicular to the planes of the blade edges and substantially symmetrical with respect to the plane of symmetry of the cutting edges of the blades.

As the wedge stock is fed through the cutting location, it passes through opening 84 in frame part 66, and through opening 86 in fixed blade 68. As soon as the wedge stock reaches the trigger, the air cylinder is activated, blade 18 moves upwardly and cuts off the wedge stock which drops into collecting tray 20.

Wedge stock can be fed very rapidly through the cutting location since cutting takes place automatically as soon as the end of the wedge stock reaches the trigger. Because of the rapidity with which the device is capable of operating, it is desirable to count the number of wedges produced, and a mechanical counter 88 is provided for this purpose. It is operated by head 54 of the air cylinder rod 52 through arm 90 (see also FIG. 5).

Figure 5:
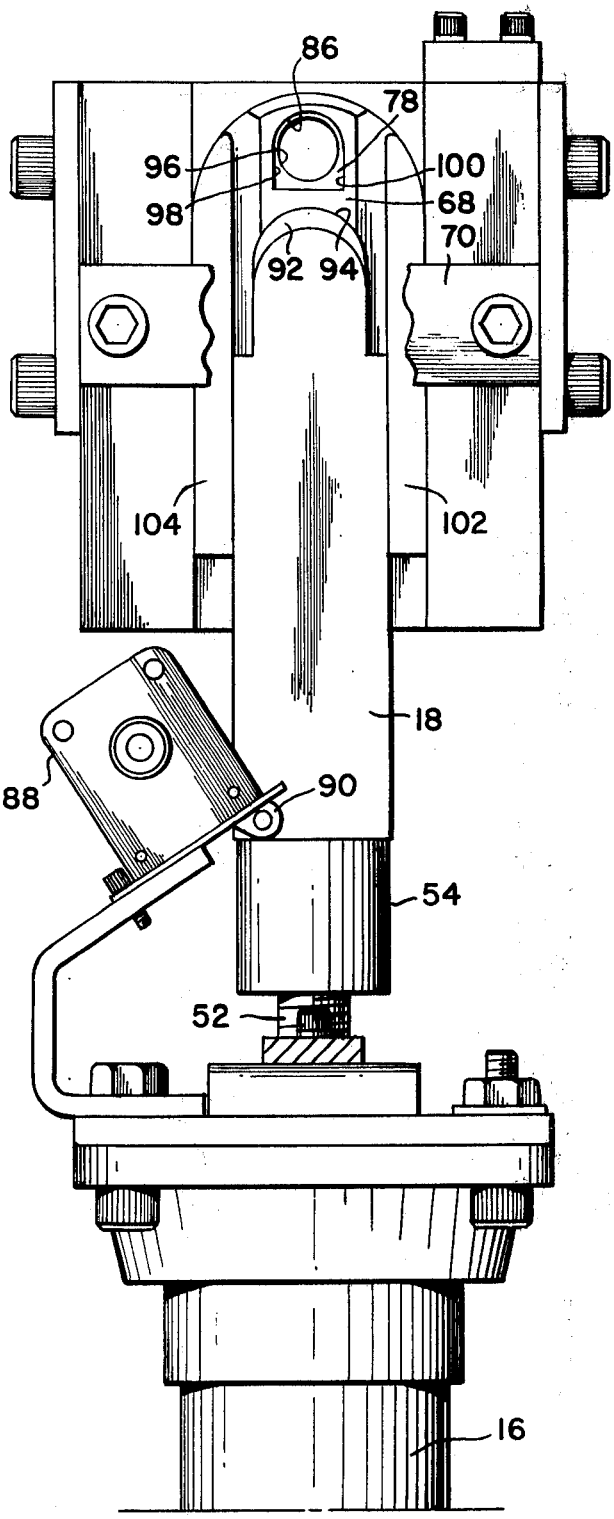
FIG. 5 is an elevation of the cutting apparatus, as viewed through surface 5—5 of FIG. 1 with the collecting tray, and part of the frame broken away for clarity.

FIG. 5 shows tapered end 92 of movable blade 18, which forms a U-shaped external (i.e. convex or exteriorly curved) cutting edge 94 which lies in and moves in a vertical plane perpendicular to the direction of wedge stock feed. Wedge stock is fed through opening 96 in dial 78, and through opening 86 of fixed blade 68. Opening 86 has an internal (i.e. concave or interiorly curved) U-shaped curvature comprising a rounded end terminating in substantially straight and parallel vertical parts 98 and 100. The entire cutting edge of the opening lies in a vertical plane immediately adjacent the plane of movement of movable blade edge 94. Edge 94 extends laterally beyond parts 98 and 100 of the edge of the fixed blade so that, as blade 18 moves upwardly, its edge 94 intersects the cutting edge of fixed blade 68 at acute angles. The intersections between movable cutting edge 94 and straight parts 98 and 100 of the cutting edge of the fixed blade should be within the range of approximately 50° to 80° for consistent clean cutting of various types and sizes of wedge stock. For best results, we have found that the intersections between edge 94 and parts 98 and 100 should be approximately 68°.

Blade 18 is held against lateral movement in the plane of FIG. 5 by vertical guides 102 and 104.

Figure 6:
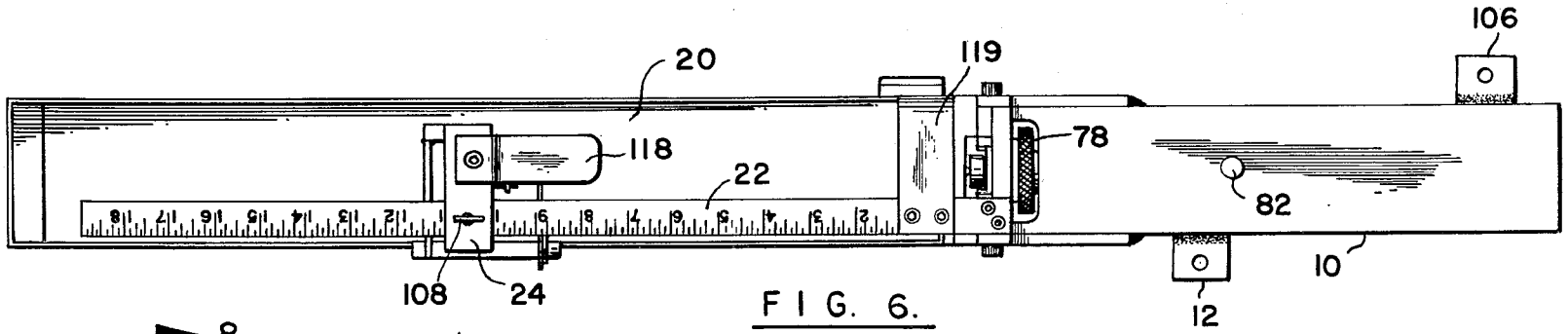
FIG. 6 is a top plan view of the cutting apparatus.

Referring to FIG. 6, bar 22, which extends over the collecting tray and guides slide assembly 24, has visible markings which are used to determine the length of the wedges to be cut. A thumb screw 108 is used to tighten the slide assembly when it is set in position.

Figure 7:
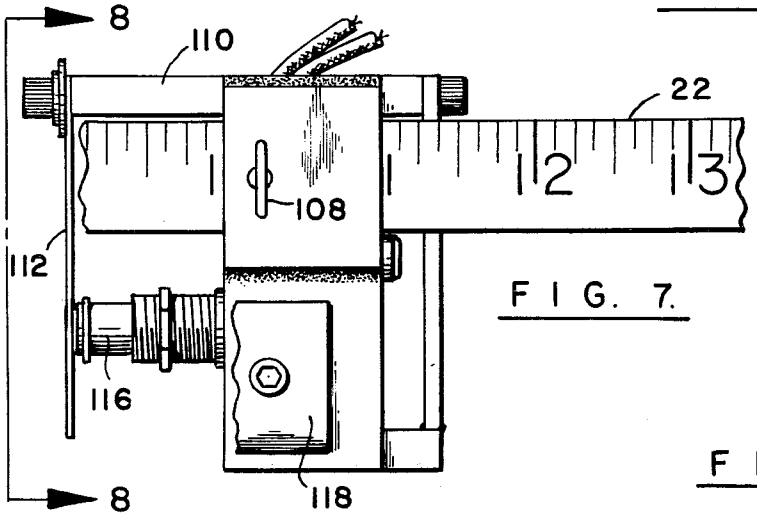
FIG. 7 is a fragmentary top plan view showing the details of a sliding trigger.
Figure 8:
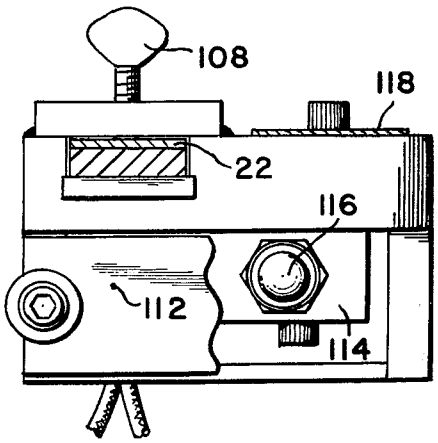
FIG. 8 is a vertical section taken on plane 8—8 of FIG. 7.

As shown in FIGS. 7 and 8, the slide assembly includes an arm 110, on the end of which is mounted a flexible, resilient paddle 112 of spring metal. Paddle 112 is engageable by the end of the wedge stock projecting through the cutting location, and activates a microswitch 114 through button 116. Microswitch 114, when activated by movement of paddle 112, closes an electrical circuit to the solenoid valve which operates the air cylinder. The paddle and microswitch are mounted in positions such that the paddle normally exerts a force against button 116 almost but not quite sufficient to trip the microswitch. The proper relationship between the paddle and the microswitch can be achieved by the use of removable shims between the paddle and its mounting arm to adjust the position of the paddle, or by adjusting the position of the microswitch. When the microswitch and the paddle are properly adjusted so that the microswitch button is partly pushed in by the paddle, only a very slight movement of the paddle is needed to trigger the air cylinder into operation. This relationship of the paddle and the microswitch makes the device capable of cutting very uniform and precisely measured wedges.

Slide assembly 24 also carries an overhanging shield 118, seen in FIGS. 6, 7 and 8. The purpose of shield 118 is to prevent wedges from flying upwardly when cut off by the upward movement of movable blade 18. As the shield is carried by the slide assembly, it performs its protective function regardless of the length of the wedge to be cut, since it always catches the end of the wedge remote from the cutting location. The end of the wedge at the cutting location is always caught by overhanging frame member 119.

Figure 9:
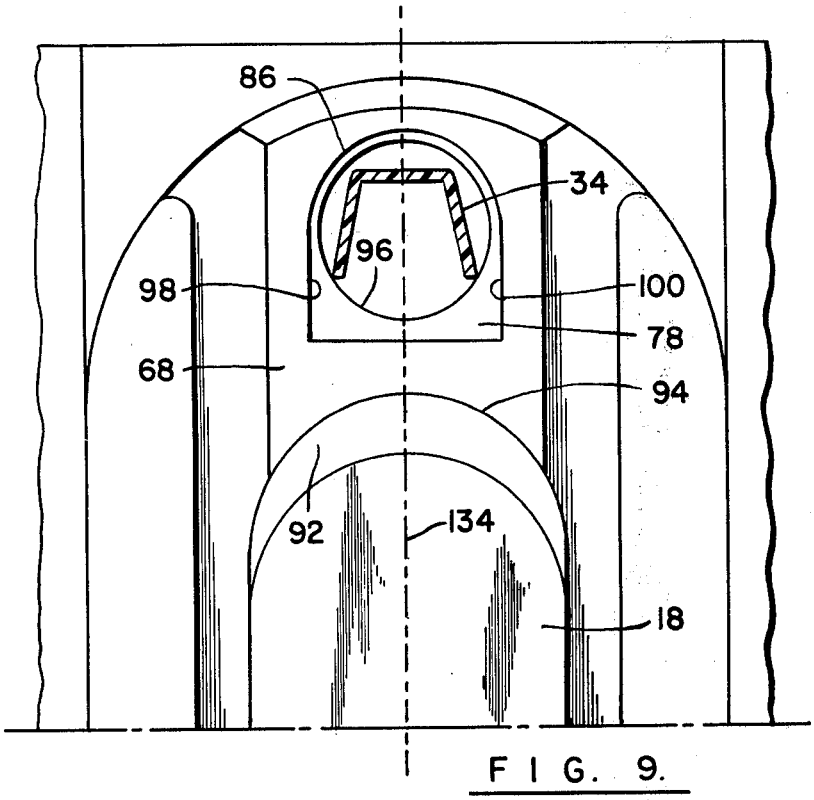
FIG. 9 is a fragmentary elevational view of the cutter blades taken along a plane transverse to the direction of stock feed, and illustrating the blades in the rest position.

Movable blade 18 is shown in its rest position in FIG. 9. Wedge stock 34 extends through opening 96 in dial 78. The lower edges of its legs engage the edge of opening 96, and the wedge stock is centered about plane 134, which is a plane of symmetry for both blades. In order to insure that the desired opening of the dial guide is properly aligned with the blades, a suitable detent device such as a spring-loaded ball detent (not shown) may be provided.

Figure 10:
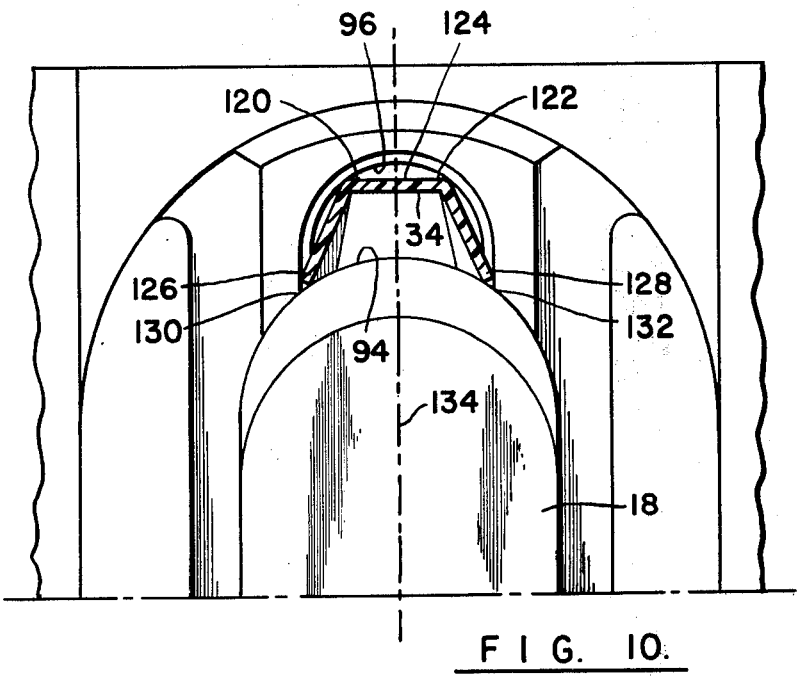
FIG. 10 is a view similar to FIG. 9, showing the blades at an intermediate position between the rest position and the cut-off position.

As blade 18 moves upwardly, its cutting edge 94 engages edges 126 and 128 of the wedge stock, and moves the wedge stock upwardly so that its corners 120 and 122 engage the upper part of opening 96 if such engagement has not already taken place as a result of the size of the wedge stock. As the movable blade continues to move upwardly, it causes edges 126 and 128 of the wedge stock to move outwardly against parts 98 and 100 of the edge of the fixed blade. In FIG. 10, edge 94 forms an acute angle 130 with part 98 of the fixed blade edge, and also forms an acute angle 132 with part 100 of the fixed blade edge. A shearing action takes place as the movable blade continues to move upwardly as a result of the cooperation of the blade edges in forming angles 130 and 132. Ultimately, the wedge stock is cut off completely.

The centering of the wedge stock on the plane of symmetry 134 by guide dial 78 insures a minimum of deformation of the wedge stock in the cutting operation. Surprisingly, by using the particular blade configuration described above together with the centering device, a wide range of sizes and shapes of wedge stock can be cut perfectly. The device produces very effective high speed cutting of wedge stock with little, if any, waste due to imperfect cutting.

The invention also avoids the waste which necessarily occurs when wedge elements are cut together in a bundle using a cutting wheel.

The slot wedge cutting apparatus in accordance with the invention can be modified in various respects. For example, while the air cylinder is desirable as a blade actuating device because it operates at comparatively low temperatures and because it provides for a rapid return of the blade to its rest position, the blade can be activated alternatively by an electrical solenoid. The wedge stock guide dial can be replaced, if desired, by individual apertured inserts, or by a slide having multiple apertures of different sizes. While it is much simpler to apply pressure to the movable blade to urge it against the fixed blade, it is possible to provide suitable guides for the movable blade, and to apply pressure to the fixed blade, urging it against the movable blade.

These and various other modifications can be made to the apparatus described herein without departing from the scope of the invention as defined in the following claims.

We claim:

1. Apparatus for cutting slot wedges for electrical rotating machines from wedge stock, the stock consisting of elongated strips of insulating material having generally U-shaped transverse cross-sections, the apparatus comprising:

shearing means;

means, located on one side of the shearing means, for guiding wedge stock in a predetermined direction toward the shearing means; and means located on the other side of the shearing means, and actuable by an end of the wedge stock extending through the shearing means, for actuating the shearing means;

the shearing means comprising a frame, a first blade mounted on said frame and having an external U-shaped cutting edge lying in a first plane generally perpendicular to the direction of feed of wedge stock, and a second blade mounted on said frame and having an internal U-shaped cutting edge having a rounded end and substantially straight and parallel sides, said internal edge lying in a second plane immediately adjacent and parallel to said first plane, the U-shaped cutting edges of both blades being substantially symmetrical about a plane of symmetry perpendicular to said first and second planes, the blades being relatively movable, in said first and second planes in the direction of the intersections of said first and second planes by said plane of symmetry, from a rest position in which the rounded end and at least part of the straight sides of the cutting edge of the second blade are external to the curvature of the cutting edge of the first blade to a cut-off position in which the cutting edge of the first blade is external to the curvature of the rounded end of the cutting edge of the second blade, the cutting edge of the first blade being sufficiently wide in the first plane to intersect the cutting edge of the second blade during relative movement of the blades from the rest position to the cut-off position, and the cutting edges of both blades being so configured that, when they intersect each other, the cutting edges of the respective blades intersect each other at acute angles;

whereby relative movement of the blades from the rest position to the cut-off position causes spreading of the sides of the U-shaped wedge stock outwardly against the sides of the internal U-shaped cutting edge of the second blade, followed by cutting of an insulation wedge from the wedge stock.

2. Apparatus according to claim 1 in which the cutting edges of the blades are so configured that, when the external U-shaped cutting edge of the first blade intersects the substantially straight and parallel sides of the internal U-shaped cutting edge of the second blade, the intersections of the cutting edges are at acute angles in the range of approximately 50° to 80°.

3. Apparatus according to claim 1 in which the cutting edges of the blades are so configured that, when the external U-shaped cutting edge of the first blade intersects the substantially straight and parallel sides of the internal U-shaped cutting edge of the second blade, the intersections of the cutting edges are at acute angles of approximately 68°.

4. Apparatus according to claim 1 in which the guide means comprises means for maintaining the wedge stock with its transverse cross-sections substantially symmetrical with respect to said plane of symmetry.

5. Apparatus according to claim 4 in which the guide means comprises a plate with a plurality of apertures of different sizes, and means for positioning any selected one of said apertures in alignment with said plane of symmetry at a location such that wedge stock extending through said selected aperture in a direction perpendicular to said first and second planes can extend through the space between the cutting edges of the blades when the blades are in the rest position.

6. Apparatus according to claim 4 in which said guide means comprises an upward protrusion secured to said frame on said one side of the shearing means, spaced from the shearing mens in a direction perpendicular to said first and second planes and aligned with the space between the cutting edges of said blades when said blades are in the rest position.

7. Apparatus according to claim 1 in which said second blade of the shearing means is fixed to said frame, and said shearing means comprises: guide means for constraining said first blade so that its cutting edge moves in said first plane while remaining symmetrical about said plane of symmetry; an air cylinder for moving said first blade, said air cylinder having a piston movable in the direction of movement of said first blade; and a head on said piston arranged to engage the end of said first blade opposite the cutting edge thereof to effect movement of said first blade, said head having a flat surface for engaging said end of said first blade, said flat surface being in a plane mutually perpendicular to said first plane and said plane of symmetry.

8. Apparatus according to claim 1 including guide means for said relatively movable blades, said guide means comprising means for continuously applying pressure to one of said blades urging it against the other of said blades.

9. Apparatus according to claim 1 in which said second blade of the shearing means is fixed to said frame, and said shearing means comprises guide means for constraining said first blade so that its cutting edge moves in said first plane while remaining symmetrical about said plane of symmetry, said guide means comprising means for continuously applying pressure to said first blade and urging said first blade against said second blade.

10. Apparatus according to claim 9 in which said means for continuously applying pressure comprises a ball bearing, and spring means urging said ball bearing against said first blade.

11. Apparatus according to claim 9 in which said means for continuously applying pressure comprises a ball bearing, spring means in compression and urging said ball bearing against said first blade, and means for adjusting the compression of said spring means.

12. Apparatus according to claim 1 in which the means for actuating the shearing means comprises a microswitch having a button, and a flexible, resilient paddle engaging the button and normally stressed so that it exerts a force on the button in a direction to trigger the microswitch but insufficient in magnitude to trigger the microswitch without the application of an additional force, said paddle being positioned to be actuated by an end of the wedge stock extending through the shearing means whereby the wedge stock applies said additional force to the paddle.

13. Apparatus according to claim 1 in which the relatively movable blades of the shearing means are so arranged as to urge the remote end of the wedge being cut in the upward direction, and in which said means actuable by an end of the wedge stock for actuating the shearing means is movable toward and away from the shearing means for adjustment of the length of the slot wedges cut by the shearing means, and carries with it an overhanging shield extending toward the shearing means beyond the location at which wedge stock engages the actuable means.

* * * * *